US006962651B2

(12) United States Patent
Miller et al.

(10) Patent No.: US 6,962,651 B2
(45) Date of Patent: Nov. 8, 2005

(54) METHOD FOR PRODUCING A PLURALITY OF LUBRICANT BASE OILS FROM PARAFFINIC FEEDSTOCK

(75) Inventors: Stephen J. Miller, San Francisco, CA (US); John M. Rosenbaum, Richmond, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 60 days.

(21) Appl. No.: 10/383,569

(22) Filed: Mar. 10, 2003

(65) Prior Publication Data

US 2004/0181109 A1 Sep. 16, 2004

(51) Int. Cl.[7] ..... C01G 65/02; C01G 67/02

(52) U.S. Cl. ..... 208/95; 208/27; 208/96; 208/950

(58) Field of Search ..... 208/27, 95, 96, 208/950

(56) References Cited

U.S. PATENT DOCUMENTS

| | | | | |
|---|---|---|---|---|
| 3,852,207 | A | 12/1974 | Stangeland | |
| 3,904,513 | A | 9/1975 | Fischer | |
| 4,157,294 | A | 6/1979 | Iwao et al. | |
| 4,347,121 | A | 8/1982 | Mayer et al. | |
| 4,401,556 | A | 8/1983 | Bezman et al. | |
| 4,810,357 | A | 3/1989 | Chester et al. | |
| 4,820,402 | A | 4/1989 | Partridge et al. | |
| 4,822,476 | A | 4/1989 | Ziemer et al. | |
| 4,913,799 | A | 4/1990 | Gortsema et al. | |
| 4,943,672 | A * | 7/1990 | Hamner et al. | 585/737 |
| 4,975,177 | A | 12/1990 | Garwood et al. | |
| 5,037,528 | A | 8/1991 | Garwood et al. | |
| 5,059,567 | A | 10/1991 | Linsten et al. | |
| 5,073,530 | A | 12/1991 | Bezman et al. | |
| 5,114,563 | A | 5/1992 | Lok et al. | |
| 5,198,203 | A | 3/1993 | Kresge et al. | |
| 5,246,689 | A | 9/1993 | Beck et al. | |
| 5,282,958 | A | 2/1994 | Santilli et al. | |
| 5,306,860 | A * | 4/1994 | Bigeard et al. | 585/737 |
| 5,334,368 | A | 8/1994 | Beck et al. | |
| 5,643,440 | A | 7/1997 | Borghard et al. | |
| 6,008,164 | A * | 12/1999 | Aldrich et al. | 508/110 |
| 6,051,129 | A | 4/2000 | Harris et al | |
| 6,090,989 | A | 7/2000 | Trewella et al. . | |
| 6,179,994 | B1 | 1/2001 | Clark et al. | |
| 6,204,426 | B1 | 3/2001 | Miller et al. | |
| 6,468,417 | B1 | 10/2002 | Biscardi et al. | |
| 6,468,418 | B1 | 10/2002 | Biscardi et al. | |
| 6,506,297 | B1 | 1/2003 | Wittenbrink et al. | |
| 2004/0045868 | A1 * | 3/2004 | Germaine | 208/58 |
| 2004/0065588 | A1 * | 4/2004 | Genetti et al. | 208/108 |

FOREIGN PATENT DOCUMENTS

| | | | | |
|---|---|---|---|---|
| EP | 0321307 | A2 | 6/1989 | |
| EP | 776959 | A2 * | 6/1997 | C10G/65/04 |
| WO | 96/13563 | A1 | 5/1996 | |
| WO | 97/21788 | A1 | 6/1997 | |
| WO | 99/41332 | A1 | 8/1999 | |
| WO | 99/41335 | A1 | 8/1999 | |
| WO | 99/41337 | A1 | 8/1999 | |
| WO | 99/45085 | A1 | 9/1999 | |
| WO | 03/070857 | | 8/2003 | |

OTHER PUBLICATIONS

United Kingdom Search Report dated Jul. 30, 2004.

U.S. Appl. No. 10/383,612, Miller et al., *Isomerization/Dehazing Process for Base Oils from Fischer–Tropsch Wax* filed on Mar. 10, 2003.

Zakarian, J.A., et al., "All–Hydroprocessing Route for High-Viscosity Index Lubes, Energy Progress", 7(1):59 (1987).

* cited by examiner

*Primary Examiner*—Walter D. Griffin
(74) *Attorney, Agent, or Firm*—Burns, Doane, Swecker & Mathis, L.L.P.

(57) ABSTRACT

A method for producing lubricant base oils is provided comprising the steps of: (a) hydroisomerizing a feedstock over a medium pore size molecular sieve catalyst under hydroisomerization conditions to produce an isomerized product having a pour point of greater than a target pour point of the lubricant base oils; (b) separating the isomerized product into at least a light lubricant base oil having a pour point less than or equal to the target pour point of the lubricant base oils and a heavy fraction having a pour point of equal to or greater than the target pour point of the lubricant base oils and a cloud point greater than the target cloud point of the lubricant base oils; and (c) dehazing the heavy fraction to provide a heavy lubricant base oil having a pour point less than or equal to the target pour point of the lubricant base oils and a cloud point less than or equal to the target cloud point of the lubricant base oils.

37 Claims, 1 Drawing Sheet

FIGURE
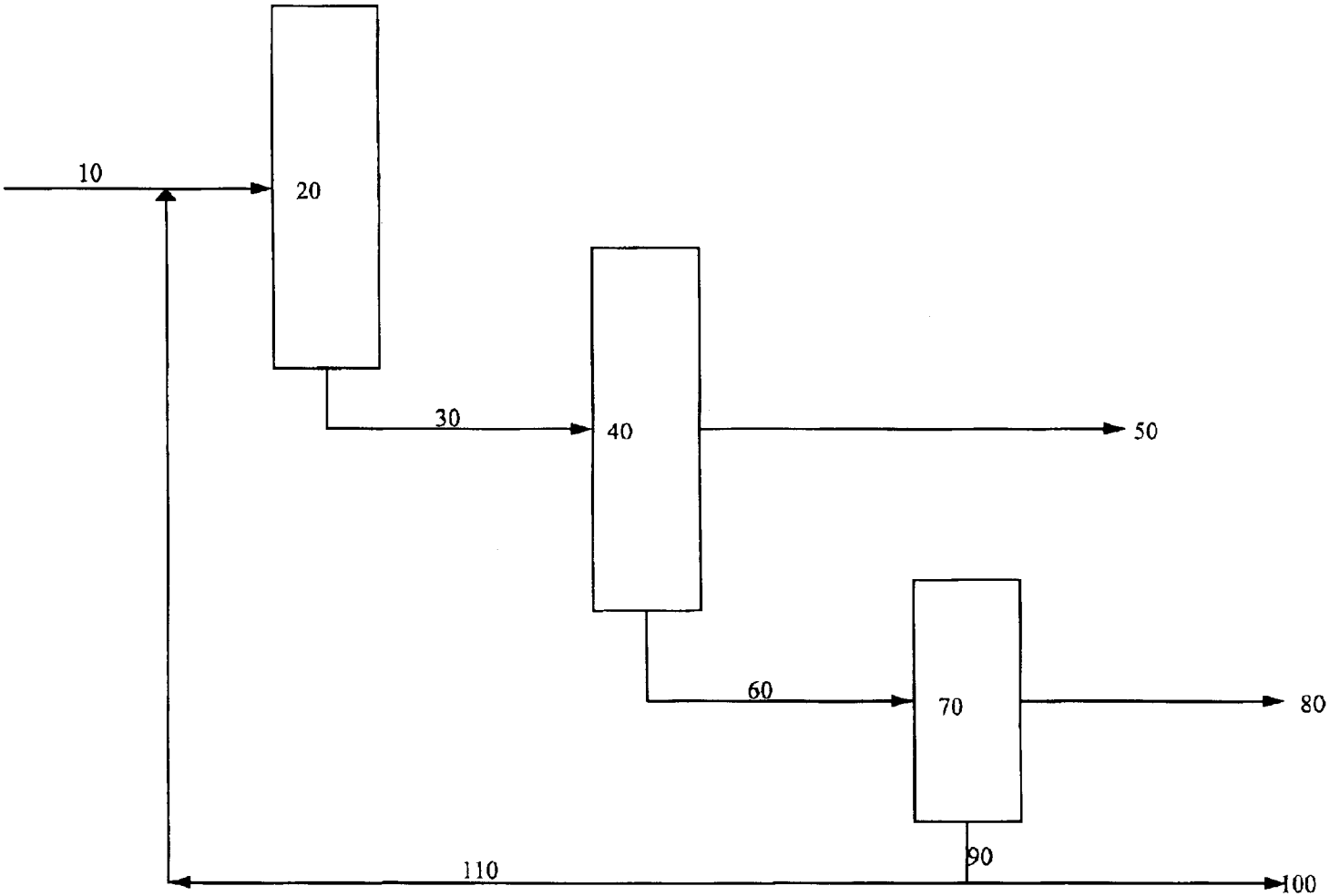

METHOD FOR PRODUCING A PLURALITY OF LUBRICANT BASE OILS FROM PARAFFINIC FEEDSTOCK

FIELD OF THE INVENTION

The present invention relates to a process for preparing lubricant base oils from a paraffinic feedstock, such as a Fischer-Tropsch wax.

BACKGROUND OF THE INVENTION

Lubricant base oils are generally prepared by fractionating a vacuum gas oil fraction into narrow boiling range fractions, and hydrocracking and/or hydroisomerizing the narrow boiling range fractions. The fractionation is generally performed prior to the hydrocracking/hydroisomerization in an effort to increase the lubricant base oil yield and to produce the highest quality lubricant base oils.

Various processes for producing lubricant base oils are known in the art. The goal of these processes is to produce lubricant base oils with high viscosity indices and low pour points.

International Publication Number WO 96/13563 teaches a process for producing a high viscosity index lubricant having a viscosity of at least 125 from a waxy hydrocarbon feed having a wax content of at least 40 weight percent (wt. %). The disclosed process comprises catalytically dewaxing waxy paraffins present in the feed primarily by isomerization, in the presence of hydrogen and in the presence of a low acidity large pore zeolite molecular sieve having a crystal size of less than 0.1 micron, an alpha value of not more than 30 and containing a noble metal hydrogenation component. The effluent of the process may be further dewaxed by either solvent or catalytic means in order to achieve target pour point.

International Publication Number WO 99/41337 teaches a method of producing a lubricant oil feedstock from a waxy feed. Waxy feeds are treated under hydroisomerization conditions to produce an isomerate product of high viscosity index by using a silica-alumina based catalyst with a pore volume of less than 0.99 ml/gm ($H_2O$), an alumina content in the range of 35 to 55 wt. %, and an isoelectric point in the range of 4.5 to 6.5. Following isomerization the isomerate is fractionated into a lubricant cut boiling in the 330° C.+ range and a fuel cut. The lubricant fraction is then dewaxed to provide a lubricant basestock of high viscosity index.

International Publication Number WO 99/41332 teaches a method of making a wax isomerate oil having a viscosity index of from 110 to 160 and a pour point of less than −20° C. The method comprises the steps of hydrotreating a wax having a mean boiling point of from 400 to 500° C. and containing not more than 20% oil, isomerizing the hydrotreated wax over an isomerization catalyst, fractionating the resulting isomerate to recover a fraction having a viscosity in the range of about 3.0 to 5.0 cSt at 100° C. and boiling above about 340° C., and dewaxing the recovered fraction.

European Patent EP 0321307 teaches a process for the production of non-conventional lubricant oil base stocks or blending stocks of very low pour point (−21° C. or lower) and very high viscosity index (130 and higher) by the isomerization of waxes over isomerization catalysts in an isomerization unit. The total product from the isomerization unit is fractionated into a lubricant oil fraction boiling in the 330° C.+ range and a fuel cut. The lubricant oil fraction is then solvent dewaxed and unconverted wax is recycled to the isomerization unit.

International Publication Number WO 97/21788 discloses a process for the manufacture of biodegradable high performance hydrocarbon base oils. According to the process, a waxy, or paraffinic feed, particularly a Fischer-Tropsch wax, is reacted over a dual function catalyst to produce hydroisomerization and hydrocracking reactions sufficient to produce a crude fraction containing 700° F.+ isoparaffins. The methyl paraffins containing crude fraction is topped via atmospheric distillation to produce a heavy fraction having an initial boiling point between about 650 and 750° F. which is then solvent dewaxed. The dewaxed oil is then fractionated under high vacuum to produce biodegradable high performance hydrocarbon base oils.

U.S. Pat. No. 4,975,177 teaches a process of producing lubricant basestocks of high viscosity index (typically at least 130 or higher) and low pour point (typically below 5° F.) by hydroisomerizing petroleum waxes over zeolite beta and then dewaxing to target pour point. A preferred process employs a solvent dewaxing after the hydroisomerization step to effect a partial dewaxing with the separated waxes being recycled to the hydroisomerization step; dewaxing is then completed catalytically, typically over ZSM-5 or ZSM-23.

International Publication Number WO 99/41335 teaches a method for producing a lubricant basestock from a waxy feed containing 50 wt. % or more of wax. The feed is upgraded by a process comprising the steps of hydrotreating the feed to produce a material of reduced sulfur and nitrogen and hydroisomerizing the hydrotreated material over a low fluorine content, alumina based, hydroisomerization catalyst to reduce the wax content to less than about 40 wt. %. The feed is then separated into a fraction boiling below about 340° C. and a lubricant fraction boiling above about 340° C. The lubricant fraction is further processed over a catalyst comprising a mixture of a catalytically active metal component on a zeolite dewaxing catalyst and a catalytically active metal component on an amorphous catalyst. Optionally, the lubricant fraction is first solvent dewaxed before further processing.

A disadvantage of conventional processes is that they cannot effectively hydroisomerize a broad boiling range hydrocarbonaceous highly waxy feedstock to produce both heavy and light lubricant base oils that have acceptable pour and cloud points, viscosity indices, and yields.

When a conventional process is used to isomerize a broad boiling range feedstock to produce a high quality light lubricant base oil (i.e., with an acceptable pour point and viscosity index), a relatively high pour point heavy lubricant base oil is formed. When a conventional process is used to isomerize a broad boiling range feedstock to produce a high quality heavy lubricant base oil (i.e., with an acceptable pour point and viscosity index), a relatively low viscosity index light lubricant base oil is formed in relatively low yields. In order to produce both a heavy and a light lubricant base oil with acceptable pour points and viscosity indices from a broad boiling range feed, the light portion is typically overdewaxed to produce heavy lubricant base oils with acceptable properties. Overdewaxing the light portion increases branching, thereby lowering the viscosity index of the light portion. The conventional solution to avoid overdewaxing a broad boiling range feedstock is to fractionate the broad boiling range feedstock into narrow boiling range fractions and then hydroisomerize each narrow boiling range fraction. This solution results in increased production cost and complexity.

It would be advantageous to provide a relatively low-cost, low-complexity process for producing a plurality of lubricant base oils with acceptable pour points, viscosity indices, and yields from a broad boiling range feedstock.

SUMMARY OF THE INVENTION

The present invention relates to processes for producing a plurality of lubricant base oils from a paraffinic feedstock. In one method of the present invention, a paraffinic feedstock is hydroisomerized over a medium pore size molecular sieve catalyst under hydroisomerization conditions to produce an isomerized product having a pour point greater than a target pour point of the lubricant base oils. The isomerized product is then separated into at least a light lubricant base oil having a pour point less than or equal to the target pour point of the lubricant base oils and a heavy fraction having a pour point of equal to or greater than the target pour point of the lubricant base oils, and a cloud point greater than the target cloud point of the lubricant base oils. Finally, the heavy fraction is dehazed to provide a heavy lubricant base oil having a pour point less than or equal to the target pour point of the lubricant base oils and a cloud point less than or equal to the target cloud point of the lubricant base oils.

In one method according to the present invention, the present invention relates to a method for producing lubricant base oils. In this method, a paraffinic feedstock is hydroisomerized over a medium pore size molecular sieve catalyst under hydroisomerization conditions to produce an isomerized product having a pour point greater than a target pour point of the lubricant base oils. The paraffinic feedstock is derived from a Fischer-Tropsch synthesis and has an initial boiling point of less than 750° F. and an end boiling point of greater than 900° F. The isomerized product is separated into at least a light lubricant base oil having a pour point less than or equal to the target pour point of the lubricant base oils and a heavy fraction having a pour point of equal to or greater than the target pour point of the lubricant base oils and a cloud point greater than the target cloud point of the lubricant base oils. The light lubricant base oil has a viscosity index of greater than 130. The heavy fraction is then dehazed to provide a heavy lubricant base oil having a pour point less than or equal to the target pour point of the lubricant base oils, a cloud point less than or equal to the target cloud point of the lubricant base oils, the heavy lubricant base oil having a viscosity index of greater than 140.

In yet another aspect, the present invention relates to a method for treating a paraffinic feedstock. In the method, the paraffinic feedstock is hydroisomerized over a medium pore size molecular sieve catalyst under hydroisomerization conditions to produce an isomerized product. The isomerized product is then separated into a light lubricant base oil having a pour point less than −9° C., preferably in the range of −10° C. to −24° C. and a heavy fraction having a pour point of equal to or greater than −10° C. to −24° C. The heavy fraction is dehazed to provide a heavy lubricant base oil and a wax fraction wherein the heavy lubricant base oil has a pour point less than −9° C., preferably in the range of −10° C. to −24° C. and wherein the pour point of the heavy fraction is no more than 10° C., preferably no more than 5° C., higher than that of heavy lubricant base oil, and the cloud point of the heavy fraction is more than 10° C. higher than that of the heavy lubricant base oil.

In further embodiments the methods of the present invention may further comprise the steps of recovering wax removed from the heavy fraction during the dehazing step and repeating the first three steps, wherein at least a portion of the paraffinic feedstock hydroisomerized in the first step comprises the wax recovered from the dehazing step. The methods of the present invention may also comprise the step of hydrotreating the paraffinic feedstock before hydroisomerization.

BRIEF DESCRIPTION OF THE DRAWING

The FIGURE illustrates a schematic representation of one embodiment of the process of the present invention.

DETAILED DESCRIPTION OF THE INVENTION

According to the present invention, a process is provided for producing a plurality of lubricant base oils from a paraffinic feedstock. The process involves hydroisomerizing a paraffinic feedstock to produce an isomerized product, separating the isomerized product into at least a light lubricant base oil and an heavy fraction, and dehazing the heavy fraction.

By using the process of the present invention, a broad boiling range paraffinic feedstock (i.e., a paraffinic feedstock having an initial boiling point of less than 750° F. and an end boiling point of greater than 900° F., and more preferably having an initial boiling point of less than 725° F. and an end boiling point of greater than 950° F., may be used to produce both a heavy lubricant base oil and a light lubricant base oil having acceptable properties. Acceptable properties of light lubricant base oils include initial boiling points in the range of 600 to 750° F. and end boiling points in the range of 800 to 960° F. Light lubricant base oils generally have viscosities in the range of 3 to 6 cSt at 100° C. and viscosity indexes in the range of 95 to 170 as measured by ASTM D445-88. Heavy lubricant base oils have initial boiling points in the range of 800 to 950° F. and end boiling points in the range of 1000 to greater than 1200° F., and viscosities in the range of 8 to greater than 15 cSt at 100° C. Target pour points for lubricant base oils are less than −9° C., preferably in the range of −10 to −24° C. as measured by ASTM D5950-96. Target cloud points for lubricant base oils are less then 0° C., preferably in the range of 0° C. to −20° C. as measured by ASTM D5773 95.

Unlike the processes described in the Background section above, the process of the present invention fractionates an isomerized product into at least two lubricant base oils and then dehazes only the heavy fraction. The present invention allows for the production of the two lubricant base oils from a broad boiling paraffinic feedstock without sacrificing the quality (e.g., the pour point or the viscosity index) or the yield of either of the fractions. In other words, the present invention allows a broad boiling paraffinic feedstock to be used to produce both a heavy lubricant base oil and a light lubricant base oil in higher yields and/or higher quality than when using conventional processes. In addition, the process of the present invention does not require fractionation of the broad boiling feedstock before hydroisomerization, which decreases the cost and complexity of the present invention as compared to processes that require fractionation of a feedstock followed by separate processing of each fraction.

Definitions

Unless otherwise stated, the following terms used in the specification and claims have the meanings given below:

"Heavy fraction" is the higher boiling fraction separated from the isomerized product. The heavy fraction is comprised of a heavy lubricant base oil and a wax fraction. Properties of heavy fractions include wax content between 0.1 and 5 weight %. A bottoms fraction is a specific example of a heavy fraction.

"Bottoms fraction" means the heavier fraction separated by fractionation from the isomerized product as a non-vaporized (i.e. residuum) fraction.

"Derived from a Fischer-Tropsch synthesis" means that the fuel or product in question originates from or is produced at some stage by a Fischer-Tropsch process.

"Fischer-Tropsch wax" means a product from a Fischer-Tropsch process which contains greater than 50% wax, more preferably greater than about 80% wax, most preferably greater than about 90% wax. As used herein, wax content is determined by a solvent dewaxing process. The solvent dewaxing process is a standard method, and well known in the art. In the process, 300 grams of a waxy product is diluted 50/50 by volume with a 4:1 mixture of methyl ethyl ketone and toluene which had been cooled to −20° C. The mixture is cooled at a uniform slow rate in the range of about 0.5 to 4.5° C./min) to −15° C., and then filtered through a Coors funnel at −15° C. using Whatman No. 3 filter paper. The wax is removed from the filter and placed in a tarred 2 liter flask. Solvent remaining in the wax is removed on a hot plate and the wax weighed.

"Heavy lubricant base oil" means the lubricant base oil provided by dehazing of the heavy fraction. The heavy lubricant base oil is the heavier of the lubricant base oils provided by the methods of the present invention. Properties of heavy lubricant base oils include initial boiling points in the range of 800 to 950° F., end boiling points in the range of 1000 to 1200° F., and viscosities in the range of 8 to 15 cSt at 100° C.

"Hydrocarbonaceous" means a compound or substance that contains hydrogen and carbon atoms, but which can include heteroatoms such as oxygen, sulfur or nitrogen.

"Light lubricant base oil" means the lighter fraction separated from the isomerized product. The light lubricant base oil is the lighter of the lubricant base oils provided by the methods of the present invention. Properties of light lubricant base oils include initial boiling points in the range of 600 to 700° F., end boiling points in the range of 800 to 960° F., and viscosities in the range of 3 to 6 cSt at 100° C.

"Target pour point" means the desired pour point of the lubricant base oil products. The target pour point is less than −9° C., preferably in the range of −10° C. to −24° C., and may be −30° C. or less.

"Target cloud point" means the desired cloud point of the lubricant base oil products. The target cloud point is less than 0° C., preferably 0° C. to −20° C., and may be less than −20° C.

"Wax fraction" means the heavier waxy fraction provided by dehazing of the heavy fraction. Properties of wax fractions include wax content between 70 and 100 weight %. Wax fractions typically have a pour point in excess of about 20° C. and at ambient temperatures at least a portion may be solid.

Feedstock

The feedstock to the present process is a hydrocarbonaceous paraffinic feed. The feedstock has an initial boiling point of less than 600° F. and an end boiling point of greater than 1200° F., preferably has an initial boiling point of less than 750° F. and an end boiling point of greater than 900° F., and more preferably has an initial boiling point of less than 725° F. and an end boiling point of greater than 950° F. The feedstock preferably has a paraffin content of greater than 70 wt. %, more preferably greater than 80 wt. %, and most preferably greater than 90 wt. %. As used herein, the term "paraffin" encompasses normal and branched paraffins, including paraffin molecules having at least one saturated ring.

The paraffinic feedstock of the present invention includes synthetic oils and waxes such as those derived from a Fischer-Tropsch synthesis (e.g., a Fischer-Tropsch wax). Suitable feeds for use in the process of the invention also include petroleum waxes, waxy distillate stocks such as gas oils, lubricating oil stocks, high pour point polyalphaolefins, foots oils, normal alpha olefin waxes, slack waxes, deoiled waxes and microcrystalline waxes.

The feedstock is comprised of at least approximately 70 wt. % wax, preferably greater and 80 wt. % wax, and most preferably greater than 90 wt. % wax.

Optional Hydrotreating

The feedstock to the hydroisomerization process may optionally be subjected to hydrotreating before performing the hydroisomerization step as discussed in detail below in order to improve the quality of the feedstock. This hydrotreating process may be used to remove impurities in the feed, but it is not a hydrocracking process.

Hydrotreating is a catalytic process, usually carried out in the presence of free hydrogen, in which the primary purpose is the desulfurization and/or denitrification of the feedstock. Generally, in hydrotreating operations cracking of the hydrocarbon molecules, i.e., breaking the larger hydrocarbon molecules into smaller hydrocarbon molecules, is minimized and the unsaturated hydrocarbons are either fully or partially hydrogenated. When hydrotreating feeds derived from a Fischer-Tropsch process, hydrotreating is carried out in large part to reduce the oxygenate content of the feed, where oxygenates are primarily in the form of alcohols, but can also be in other oxygenated compounds such as ketones and aldehydes Catalysts used in carrying out hydrotreating operations are well known in the art. See for example U.S. Pat. Nos. 4,347,121 and 4,810,357, the contents of which are hereby incorporated by reference in their entirety, for general descriptions of hydrotreating, hydrocracking, and typical catalysts used in each process.

Suitable catalysts include noble metals from Group VIII (according to the 1975 rules of the International Union of Pure and Applied Chemistry), such as platinum or palladium on an alumina, silica or silica-alumina matrix, and Group VIII and Group VIB or IVA metals, such as nickel-molybdenum, nickel-tungsten or nickel-tin on an alumina, silica or silica-alumina matrix. The non-noble metals are usually employed in sulfided form. U.S. Pat. No. 3,852,207 describes a suitable noble metal catalyst and mild conditions. Other suitable catalysts are described, for example, in U.S. Pat. No. 4,157,294, and U.S. Pat. No. 3,904,513. Preferred non-noble metal catalyst compositions contain in excess of about 5 wt. %, preferably about 5 to about 40 wt. % molybdenum and/or tungsten, and at least about 0.5, and generally about 1 to about 15 wt. % of nickel and/or cobalt determined as the corresponding oxides. The noble metal (such as platinum) catalyst contains in excess of 0.01 percent metal, preferably between 0.1 and 1.0 percent metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VI components, i.e.; molybdenum and tungsten can be combined with the refractory oxide by impregnation, co-mulling or co-precipitation.

The matrix component can be of many types including some that have acidic catalytic activity. Ones that have activity include amorphous silica-alumina or a zeolitic or non-zeolitic crystalline molecular sieve. Examples of suitable matrix molecular sieves include zeolite Y, zeolite X and the so called ultra stable zeolite Y and high structural silica:alumina ratio zeolite Y such as that described in U.S. Pat. Nos. 4,401,556, 4,820,402 and 5,059,567. Small crystal size zeolite Y, such as that described in U.S. Pat. No. 5,073,530, can also be used. Non-zeolitic molecular sieves which can be used include, for example, silicoaluminophosphates (SAPO), ferroaluminophosphate, titanium aluminophosphate and the various ELAPO molecular sieves described in U.S. Pat. No. 4,913,799 and the references cited therein. Details regarding the preparation of various non-zeolite molecular sieves can be found in U.S. Pat. No. 5,114,563 (SAPO); U.S. Pat. No. 4,913,799 and the various references cited in U.S. Pat. No. 4,913,799. Mesoporous molecular sieves can also be used, for example the M41 S family of materials (J. Am. Chem. Soc., 114:10834–10843 (1992)), MCM-41 (U.S. Pat. Nos. 5,246,689; 5,198,203; 5,334,368), and MCM-48 (Kresge et al., Nature 359:710 (1992)). The contents of each of the patents and publications referred to above are hereby incorporated by reference in their entirety.

Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to calumniation, acid treatment or chemical modification.

Typical hydrotreating conditions vary over a wide range. In general, the overall liquid hourly space velocity (LHSV) is about 0.25 to 4.0 $hr^{-1}$, preferably about 1.0 to 3.0 $hr^{-1}$. The hydrogen partial pressure is greater than 200 psia, preferably ranging from about 500 to about 2000 psia. Hydrogen re-circulation rates are typically greater than 50 SCF/Bbl, and are preferably between 1000 and 5000 SCF/Bbl. Temperatures range from about 300 to about 750° F., preferably ranging from 450 to 600° F.

Hydroisomerization

According to the present invention, the feedstock is hydroisomerized over a medium pore size molecular sieve catalyst to produce an isomerized product. The isomerized product typically has a pour point above the target pour point of the ultimate lubricant base oils. The hydroisomerization preferably converts at least 90, preferably at least 95 wt. % of the wax in the feedstock.

The medium pore size molecular sieve catalyst typically comprises a medium pore size crystalline molecular sieve (which is an acidic component) and a metal hydrogenation component, for example, as described in U.S. Pat. No. 5,135,638. The crystalline molecular sieve used in the present invention is of the 10- or 12-member ring variety and has a pore diameter of 4.8 to 7.1 Å across, preferably 5.3 to 6.5 Å. Specific molecular sieves which are useful in the process of the present invention include the zeolites ZSM-12, ZSM-21, ZSM-22, ZSM-23, ZSM-35, ZSM-38, ZSM-48, ZSM-57, SSZ-32, ferrierite and L and other molecular sieve materials based upon aluminum phosphates such as SM-3, SAPO-11, SAPO-31, SAPO-41, MAPO-11 and MAPO-31. The medium pore size molecular sieve is preferably SAPO-11, SM-3, SSZ-32, ZSM 22, or ZSM 23. Medium pore size molecular sieve catalysts are taught in U.S. Pat. No. 5,282,958, U.S. Pat. No. 6,204,426 and WO 99/45085.

The hydroisomerization of the present invention is used to reduce the pour point of the paraffinic feedstock by creating branches (primarily methyl branches) on normal paraffin molecules present in the feedstock. The extent of isomerization (i.e., the number of branches added) is related to the severity of the process. Increasing the hydroisomerization severity generally results both in increased branching and in relocation of the branches toward the center of the paraffinic chain. The pour point, the viscosity index, and the yield of an isomerized feedstock are all related to the extent of isomerization (and therefore to the severity of the hydroisomerization process) as follows:

(1) Increasing the number of branches decreases the pour point, with the largest effect being seen with the first branch. Each additional branch has a smaller effect on the pour point.

(2) Increasing the number of branches also relates to the yield of the desired product(s). Because hydroisomerization is not 100% selective, a percentage of the molecules of the feedstock are cracked rather than isomerized, thus resulting in molecules having lower molecular weights than the desired lubricant base oil. Increasing the severity of the hydroisomerization lowers the yield of the desired lubricant base oil.

(3) Increasing the number of branches tends to decrease the viscosity index of the product, particularly if the molecule has more than about 2–3 branches.

When determining the severity of the hydroisomerization used in the present invention, the undesirability of decreased viscosity index and decreased yield due to increased hydroisomerization severity must be balanced against the improved pour point of the product due to increased hydroisomerization severity. In particular, the conversion of the last few percent of the wax results in considerable loss of yield and VI. The severity of the hydroisomerization process may be controlled to produce an isomerized product having the desired balance of pour point, viscosity index, and yield.

The metal component of the medium pore size molecular sieve catalyst at least one Group VI or Group VIII metal, preferably a Group VIII metal. Preferably, the Group VIII metal is selected from the group consisting of at least one of platinum and palladium and optionally, other catalytically active metals such as molybdenum, nickel, vanadium, cobalt, tungsten, zinc and mixtures thereof. Most preferably, the Group VIII metal is selected from the group consisting of at least one of platinum and palladium. The amount of metal ranges from about 0.01 to about 10 wt. % of the molecular sieve, preferably from about 0.1 to about 5 wt. %, and more preferably from about 0.2 to about 1 wt. % of the molecular sieve. The techniques of introducing catalytically active metals into a molecular sieve are known, and preexisting metal incorporation techniques and treatment of molecular sieves to form an active catalyst such as ion exchange, impregnation or occlusion during sieve preparation are suitable for use in the present invention.

The term "metal" or "active metal" as used herein means one or more metals in the elemental state or in some form such as sulfide, oxide and mixtures thereof. Therefore, the Group VIII metal utilized in the process of this invention can mean one or more of the metals in its elemental state or in some form such as the sulfide or oxide and mixtures thereof. Regardless of the state in which the metal component actually exists, the concentrations are computed as if they existed in the elemental state.

The catalyst may also contain metals which reduce the number of strong acid sites on the catalyst and thereby lower the selectivity for cracking versus isomerization. Especially preferred are the Group IIA metals such as magnesium and calcium.

The hydroisomerization step of the invention may be conducted, for example, by contacting the feed with a fixed stationary bed of catalyst, with a fixed fluidized bed, or with a transport bed. A simple and therefore preferred configuration is a trickle-bed operation in which the feed is allowed to trickle through a stationary fixed bed in the presence of hydrogen.

The hydroisomerzation conditions employed depend on the feedstock used and the desired balance of pour point, viscosity index, and yield in the isomerized product. Generally, the temperature is from about 200 to about 475° C., preferably from about 250 to about 450° C. The pressure is typically from about 15 to about 2500 psig (103 kPa to 27.2 MPa), preferably from about 50 to about 2000 psig (345 kPa to 13.8 MPa), more preferably from about 100 to about 1500 psig (690 kPa to 10.3 MPa). The LHSV is preferably from about 0.1 to about 20 $hr^{-1}$, more preferably from about 0.1 to about 5 $hr^{-1}$, and most preferably from about 0.1 to about 1.0 $hr^{-1}$. Low pressure and low liquid hourly space velocity provide enhanced isomerization selectivity which results in more isomerization and less cracking of the feed thus producing an increased yield.

Hydrogen is present in the reaction zone during the hydroisomerization process, typically in a hydrogen to feed ratio from about 500 to about 30,000 SCF/bbl (standard cubic feet per barrel) (76 to 4540 std liters $H_2$/kg oil), preferably from about 1,000 to about 10,000 SCF/bbl (151 to 1510 std liters $H_2$/kg oil). Generally, hydrogen will be separated from the product and recycled to the reaction zone.

Fractionation of Isomerized Product

After hydroisomerizing the feedstock to produce an isomerized product, the isomerized product is fractionated to produce at least a light lubricant base oil and a heavy fraction. The fractionation can be conducted using any conventional separation process such as, for example, distillation Other fractions may be produced if desired, including more lubricant base oils.

The light lubricant base oil has a pour point less than or equal to the target pour point of the lubricant base oils, preferably −12° C. or less, and more preferably −30° C. or less. The heavy fraction has a pour point of greater than the target pour point of the lubricant base oils. The light lubricant base oil preferably has a viscosity index of greater than 130, more preferably greater than 140, and most preferably greater than 150. The catalyst and the conditions used in the hydroisomerization step may be varied to ensure that an isomerized product is produced that can be separated into fractions having desired properties (e.g., pour point, viscosity index) and/or yield.

Dehazing

After the isomerized product has been separated into at least a light lubricant base oil and a heavy fraction, the heavy fraction is subjected to dehazing. Dehazing is defined as a process which will not change the pour point of the feed by more than 10° C., preferably by more than 5° C., but does change the cloud point of the feed by more than 10° C., and preferably more than 15° C. The heavy fraction is dehazed to a pour point less than or equal to the target pour point of the lubricant base oils.

Processes which remove wax from a hydrocarbon stream are useful for the dehazing step of the present invention. The dehazing process of the present invention is a relatively mild process. Processes available in the art that may meet the requirements of the dehazing process of the present invention can include solvent dewaxing, sorbent treating such as clay treating, extraction, catalytic dehazing and the like, as long as these processes are run under conditions that provide the pour point and cloud point differentials as described above. A mild catalytic approach in which a catalyst selectively removes the last trace of wax with minimal degradation of the rest of the oil, is taught, for example, in U.S. Pat. No. 4,822,476, the entire disclosure of which is incorporated herein by reference for all purposes. An example sorbent treating process is taught in U.S. Pat. Nos. 6,468,417 and 6,468,418, the entire disclosures of which are incorporated herein by reference for all purposes.

In a separate embodiment, dehazing may be accomplished using solving dewaxing. Hazy isomerized fractions may be solvent dewaxed in a commercial process by cooling oil-solvent admixtures under controlled conditions for crystallization of the paraffinic wax present in the admixtures. In such processes, the fractions, or mixtures of fractions and dewaxing solvent, are heated to a temperature at which the wax is dissolved. The heated charge is then passed into a cooling zone wherein cooling is undertaken at a uniform slow rate in the range of about 0.5 to 4.5° C./min until a temperature is reached (e.g. −10° to −20° C.) at which a substantial portion of the wax is crystallized and the dewaxed oil product has a selected pour point temperature. Upon achieving the desired dewaxing temperature, the mixture of wax crystals, oil and solvent is subjected to solid-liquid separation for recovery of a wax free oil-solvent solution and a solid wax containing a minor proportion of oil. The separated oil-solvent solution is subjected to distillation for recovery of a solvent fraction and a dewaxed oil product fraction.

Solvents known to be useful as dewaxing solvents are the ketones containing 3 to 6 carbon atoms, for example, acetone, methylethylketone (MEK) and methylisobutylketone (MIBK); mixtures of ketones; and mixtures of ketones with aromatic hydrocarbons including benzene and toluene. Halogenated low molecular weight hydrocarbons, including dichloromethane and dichloroethane, and their mixtures are also known dewaxing solvents. Solvent dilution of waxy oil stocks maintains fluidity of the oil for facilitating easy handling, for obtaining optimum wax-oil separation, and for obtaining optimum dewaxed oil yields. The extent of solvent dilution depends upon the particular oil stocks and solvents used, the approach to filtration temperature in the cooling zone and the desired final ratio of solvent to oil in the separation zone.

There is a small amount of wax product that may be recovered from the dehazer. As the heavy fraction preferably contains less than 5 wt. % wax initially, the dehazing generally may remove up to 5 wt. % wax from the heavy fraction. The mild process of dehazing as described above is preferred over catalytically dewaxing in the traditional way to remove the remaining small amount of wax in the high boiling lubricant base oil as dehazing results in a high boiling lubricant base oil with a higher viscosity index since the oil is not degraded by a traditional catalytic process which causes more severe cracking and/or VI reduction through isomerization. Additionally, the high boiling lubricant base oil has a low cloud point which is otherwise difficult to obtain. Typically, one would not catalytically dewax the high boiling lubricant base oil since there is such a small amount of wax. After being dehazed, the heavy lubricant base oil preferably has a viscosity index of greater than 130, more preferably greater than 140, still more preferably greater than 150.

All or a portion of the wax removed in the dehazing step may be recovered and recycled to the hydroisomerization step for use in the process of the present invention and/or collected for other uses (e.g., for processing into or use as salable wax). When recycling all or a portion of the recovered wax, the wax may be subjected to the hydroisomerization step of the present invention alone or may be combined with another paraffinic feedstock. Recycling all or a portion of the recovered wax increases the yield of the process.

Optional Hydrofinishing

One or more of the isomerized lubricant base oils and the dehazed lubricant base oil(s) may optionally be subjected to hydrofinishing in a mild hydrogenation process to produce more stable lubrication oils. The hydrofinishing can be conventionally carried out in the presence of a metallic hydrogenation catalyst such as, for example, platinum on alumina. The hydrofinishing can be carried out at a temperature of from about 190 to about 340° C., a pressure of from about 400 to about 3000 psig (2.76 to 20.7 Mpa), a LHSV between about 0.1 and 20, and hydrogen recycle rates of about 400 to about 1500 SCF/bbl.

Illustrative Embodiment

The FIGURE illustrates a schematic representation of one embodiment of the present invention. Referring to the FIGURE, a fresh paraffinic feed 10 (e.g., a Fischer-Tropsch derived feedstock) is hydroisomerized under hydroisomerization conditions in hydroisomerization zone 20, which contains a medium pore size molecular sieve catalyst, to produce an isomerized product 30 having a pour point equal to or greater than the target pour point of the lubricant base oils and a cloud point greater than the target cloud point of the lubricant base oils. The isomerized product 30 is then fractionated (in fractionation zone 40) into a light lubricant base oil 50 and a heavy fraction 60. The hydroisomerization zone 20 is operated such that: (1) the light lubricant base oil 50 has a pour point less than or equal to the target pour point of the lubricant base oils; (2) the light lubricant base oil 50 has a viscosity index of greater than 130, preferably greater than 140, more preferably greater than 150; and (3) the heavy fraction 60 has a pour point of equal to or greater than the target pour point of the lubricant base oils and a cloud point greater than the target cloud point of the lubricant base oils. The heavy fraction 60 is then dehazed in dehazing zone 70. The dehazing zone 70 is operated such that, after dehazing, the heavy lubricant base oil 80 has a pour point less than or equal to the target pour point of the lubricant base oils, a cloud point less than or equal to the target cloud point of the lubricant base oils, and a viscosity index of greater than 140, preferably greater than 150. The dehazing also produces wax fraction 90. The wax fraction 90 may be directed to a wax collection route 100 where the wax fraction 90 is collected and/or may be directed to a wax recycle route 110 where the wax is recycled and mixed with feed 10 to be subjected to hydroisomerization zone 20.

While the invention has been described in detail and with reference to specific embodiments thereof, it will be apparent to one skilled in the art that various changes and modifications can be made without departing from the spirit and scope of the invention.

What is claimed is:

1. A method for producing lubricant base oils comprising the steps of:

(a) hydroisomerizing a paraffinic feedstock over a medium pore size molecular sieve catalyst under hydroisomerization conditions to produce an isomerized product having a pour point greater than a target pour point of the lubricant base oils;

(b) separating the isomerized product into at least a light lubricant base oil having a pour point less than or equal to the target pour point of the lubricant base oils and a heavy fraction having a pour point of equal to or greater than the target pour point of the lubricant base oils, and a cloud point greater than the target cloud point of the lubricant base oils; and (c) dehazing the heavy fraction to provide a heavy lubricant base oil having a pour point less than or equal to the target pour point of the lubricant base oils and a cloud point less than or equal to the target cloud point of the lubricant base oils.

2. The method of claim 1 wherein the target pour point is in the range of −10° C. to −24° C. and the target cloud point is in the range of 0° C. to −20° C.

3. The method of claim 1 wherein the target pour point is −30° C. and the target cloud point is −20° C.

4. The method of claim 1 wherein the paraffinic feedstock has an initial boiling point of less than 750° F. and an end boiling point of greater than 900° F.

5. The method of claim 1 wherein the paraffinic feedstock is derived from a Fischer-Tropsch synthesis.

6. The method of claim 5 wherein the paraffinic feedstock comprises a Fischer-Tropsch wax.

7. The method of claim 1 wherein the paraffinic feedstock comprises more than 70 wt. % paraffins.

8. The method of claim 1 wherein the paraffinic feedstock comprises more than 90 wt. % paraffins.

9. The method of claim 1 wherein the light lubricant base oil separated in step (b) has a viscosity index of greater than 130 and the heavy lubricant base oil has a viscosity index of greater than 140.

10. The method of claim 9 wherein the light lubricant base oil separated in step (b) has a viscosity index of greater than 150 and the heavy lubricant base oil has a viscosity index of greater than 150.

11. The method of claim 1 wherein the paraffinic feedstock comprises more than 70 wt. % wax.

12. The method of claim 1 wherein the heavy fraction comprises less than 5 wt. % wax.

13. The method of claim 1 wherein the medium pore size molecular sieve catalyst comprises a molecular sieve selected from the group consisting of SAPO-11, SM-3, SSZ-32, ZSM-23, ZSM-22, ZSM-35, and ZSM-48.

14. The method of claim 1 further comprising the steps of:

(d) recovering wax removed from the heavy fraction during the dehazing step (c); and (e) repeating steps (a) through (c), wherein at least a portion of the paraffinic feedstock hydroisomerized in repeated step (a) comprises the wax recovered from the dehazing step.

15. The method of claim 1 wherein step (c) lowers the pour point of the heavy fraction by less than 5° C., and lowers the cloud point of the heavy fraction by more than 10° C.

16. The method of claim 15 wherein step (c) lowers the cloud point of the heavy fraction by more than 15° C.

17. The method of claim 1 further comprising the step of hydrotreating the paraffinic feedstock before hydroisomerization.

18. A method for producing lubricant base oils comprising the steps of:

(a) hydroisomerizing a paraffinic feedstock over a medium pore size molecular sieve catalyst under hydroisomerization conditions to produce an isomerized product having a pour point equal to or greater than a target pour point of the lubricant base oils and a cloud point greater than the target cloud point of the lubricant base oils, the paraffinic feedstock being derived from a Fischer-Tropsch synthesis and having an initial boiling point of less than 750° F. and an end boiling point of greater than 900° F.;

(b) separating the isomerized product into at least a light lubricant base oil having a pour point less than or equal to the target pour point of the lubricant base oils and a heavy fraction having a pour point of equal to or greater than the target pour point of the lubricant base oils and a cloud point greater than the target cloud point of the lubricant base oils, the light lubricant base oil having a viscosity index of greater than 130; and (c) dehazing the heavy fraction to provide a heavy lubricant base oil having a pour point less than or equal to the target pour point of the lubricant base oils, a cloud point less than or equal to the target cloud point of the lubricant base oils, the heavy lubricant base oil having a viscosity index of greater than 140.

19. The method of claim 18 wherein the paraffinic feedstock comprises more than 90 wt. % paraffins.

20. The method of claim 18 wherein the light lubricant base oil separated in step (b) has a viscosity index of greater than 150 and the heavy lubricant base oil has a viscosity index of greater than 150.

21. The method of claim 18 wherein the heavy fraction comprises less than 5 wt. % wax.

22. The method of claim 18 wherein the medium pore size molecular sieve catalyst comprises a molecular sieve selected from the group consisting of SAPO-11, SM-3, SSZ-32, ZSM-22, ZSM-23, ZSM-35, and ZSM-48.

23. The method of claim 18 further comprising the steps of:

(d) recovering wax removed from the heavy fraction during the dehazing step (c); and (e) repeating steps (a) through (c), wherein at least a portion of the paraffinic feedstock hydroisomerized in repeated step (a) comprises the wax recovered from the dehazing step.

24. The method of claim 18 wherein step (c) lowers the pour point of the heavy fraction by less than 5° C., and lowers the cloud point of the heavy fraction by more than 10° C.

25. A method for treating a paraffinic feedstock comprising the steps of:

(a) hydroisomerizing the paraffinic feedstock over a medium pore size molecular sieve catalyst under hydroisomerization conditions to produce an isomerized product;

(b) separating the isomerized product into a light lubricant base oil having a pour point in the range of −10°C. to −24° C. and a heavy fraction having a pour point of equal to or greater than −10°C. to −15° C. and a cloud point of greater than 0° C.; and (c) dehazing the heavy fraction to provide a heavy lubricant base oil and a wax fraction wherein the heavy lubricant base oil has a pour point in the range of −10° C. to −15° C. and wherein the pour point of the heavy fraction is no more than 5° C. higher than that of the heavy lubricant base oil, and the cloud point of the heavy fraction is more than 10° C. higher than that of the heavy lubricant base oil.

26. The method of claim 25 wherein the paraffinic feedstock has an initial boiling point of less than 750° F. and an end boiling point of greater than 900° F.

27. The method of claim 25 wherein the paraffinic feedstock is derived from a Fischer-Tropsch synthesis.

28. The method of claim 27 wherein the paraffinic feedstock comprises a Fischer-Tropsch wax.

29. The method of claim 25 wherein the paraffinic feedstock comprises more than 70 wt. % paraffins.

30. The method of claim 25 wherein the paraffinic feedstock comprises more than 90 wt. % paraffins.

31. The method of claim 25 wherein the light lubricant base oil separated in step (b) has a viscosity index of greater than 130 and the heavy lubricant base oil has a viscosity index of greater than 140.

32. The method of claim 31 wherein the light lubricant base oil separated in step (b) has a viscosity index of greater than 150 and the heavy lubricant base oil has a viscosity index of greater than 150.

33. The method of claim 25 wherein the heavy fraction contains less than 5 wt. % wax.

34. The method of claim 25 wherein the medium pore size molecular sieve catalyst comprises a molecular sieve selected from the group consisting of SAPO-11, SM-3, SSZ-32, ZSM-22, ZSM-23, ZSM-35, and ZSM-48.

35. The method of claim 25 further comprising the step of:

(d) repeating steps (a) through (c), wherein at least a portion of the paraffinic feedstock hydroisomerized in repeated step (a) comprises the wax fraction provided in the dehazing step.

36. The method of claim 25 wherein the cloud point of the heavy fraction is more than 15° C. higher than that of the heavy lubricant base oil.

37. The method of claim 25 further comprising the step of hydrotreating the paraffinic feedstock before hydroisomerization.

* * * * *